US011235439B2

(12) United States Patent
Zhang et al.

(10) Patent No.: US 11,235,439 B2
(45) Date of Patent: Feb. 1, 2022

(54) TOOL FOR ADJUSTING THE ALIGNMENT OF A CONNECTOR

(71) Applicants: Bo Zhang, Farmington Hills, MI (US); James A Robertson, White Lake, MI (US); Robert T Connolly, Auburn Hills, MI (US); James N Settles, Wyandotte, MI (US)

(72) Inventors: Bo Zhang, Farmington Hills, MI (US); James A Robertson, White Lake, MI (US); Robert T Connolly, Auburn Hills, MI (US); James N Settles, Wyandotte, MI (US)

(73) Assignee: FCA US LLC, Auburn Hills, MI (US)

( * ) Notice: Subject to any disclaimer, the term of this patent is extended or adjusted under 35 U.S.C. 154(b) by 271 days.

(21) Appl. No.: 16/548,961

(22) Filed: Aug. 23, 2019

(65) Prior Publication Data

US 2021/0053193 A1 Feb. 25, 2021

(51) Int. Cl.
*B25B 13/06* (2006.01)
*B25B 23/00* (2006.01)

(52) U.S. Cl.
CPC ..... *B25B 13/06* (2013.01); *B25B 23/0035* (2013.01)

(58) Field of Classification Search
CPC ..... B25B 13/06; B25B 7/22; Y10T 29/53896; Y10T 29/53913
USPC ..... 29/271
See application file for complete search history.

(56) References Cited

U.S. PATENT DOCUMENTS 938,376 A * 10/1909 Friday ..... B26B 17/02 30/177
5,566,438 A * 10/1996 Bullock ..... B25B 7/02 29/237
5,580,201 A 12/1996 Brilmyer et al.
8,220,366 B1 7/2012 Fierro et al.
2005/0069382 A1 3/2005 Atwater et al.

OTHER PUBLICATIONS https://www.merriam-webster.com/dictionary Last Accessed on Jul. 16, 2021 (Year: 2021).*

* cited by examiner

*Primary Examiner* — Lee D Wilson
*Assistant Examiner* — Jonathan G Santiago Martinez
(74) *Attorney, Agent, or Firm* — Ralph E. Smith

(57) ABSTRACT

A tool for adjusting the alignment of a connector carried within slots in one or more components. The tool comprises a first member and a second member, wherein the first member and/or second member includes an alignment feature configured to react against reaction feature(s) of the one or more components to adjust the alignment of the connector within the slots. The first member includes a shaft and a tool head carried thereby. The tool head comprises a body configured to engage a first portion of the connector. The second member is configured to be coupled with the first member, and also includes a shaft and a tool head carried thereby. The tool head of the second member comprises a body configured to engage a second portion of the connector.

19 Claims, 5 Drawing Sheets

TOOL FOR ADJUSTING THE ALIGNMENT OF A CONNECTOR

FIELD

The present disclosure relates to a tool for adjusting the alignment of a connector carried within a pair of slots in one or more components.

BACKGROUND

Automotive vehicles include any number of components that are coupled with one or more other components at a joint. Oftentimes, the joint is formed by inserting a connector, for example, a bolt, through slots in two or more components being coupled together. In some instances, after the connector is inserted into the slots, its alignment therein may require adjustment for various reasons.

Where a connector in the nature of a cam bolt is used to form the joint, the alignment of the cam bolt can be easily adjusted by simply rotating the bolt, as is known in the art. Cam bolts are, however, expensive and so less expensive regular or standard bolts are often used in favor of cam bolts. While regular bolts may provide a more cost-effective option, adjusting the alignment of a regular bolt after it has been inserted into slots can prove difficult. So much so that in practice, a regular bolt requiring adjustment may be removed and replaced with a cam bolt to allow for easier adjustment. And although the use of a cam bolt facilitates easier adjustments of the bolt, the replacement of a regular bolt with a cam bolt requires heavy repair and an increase in cost.

SUMMARY

In at least some implementations, a tool for adjusting the alignment of a connector carried within a pair of slots disposed in one or more components comprises a first member and a second member, wherein at least one of the first and second members includes an alignment feature configured to react against one or more reaction features of the one or more components to adjust the alignment of the connector within the slots. The first member includes an elongate shaft and a tool head carried by the shaft. The tool head of the first member comprises a body configured to engage a first portion of the connector. The second member is configured to be coupled with the first member at a pivot joint, and also includes an elongate shaft and a tool head carried by the shaft at the distal end thereof. The tool head of the second member comprises a body configured to engage a second portion of the connector.

In at least some implementations, a tool for adjusting the alignment of a connector carried within a pair of slots disposed in one or more components comprises a first member and a second member. The first member includes an elongate shaft having a proximal end and a distal end, and a tool head carried by the shaft at the distal end thereof that comprises a body configured to engage a first portion of the connector. The first member further includes an alignment feature configured to react against one or more reaction features of the one or more components in which the slots are disposed to adjust the alignment of the connector within the slots. The second member is configured to be coupled with the first member at a pivot joint and includes an elongate shaft having a proximal end and a distal end, and a tool head carried by the shaft at the distal end thereof that comprises a body configured to engage a second portion of the connector. The second member further includes an alignment feature configured to react against one or more reaction features of the one or more components that are different from the one or more reaction features the alignment feature of the first member is configured to react against to adjust the alignment of the connector within the slots.

Further areas of applicability of the present disclosure will become apparent from the detailed description, claims and drawings provided hereinafter. It should be understood that the summary and detailed description, including the disclosed embodiments and drawings, are merely exemplary in nature intended for purposes of illustration only and are not intended to limit the scope of the invention, its application or use. Thus, variations that do not depart from the gist of the disclosure are intended to be within the scope of the invention.

DETAILED DESCRIPTION

Figure 2:
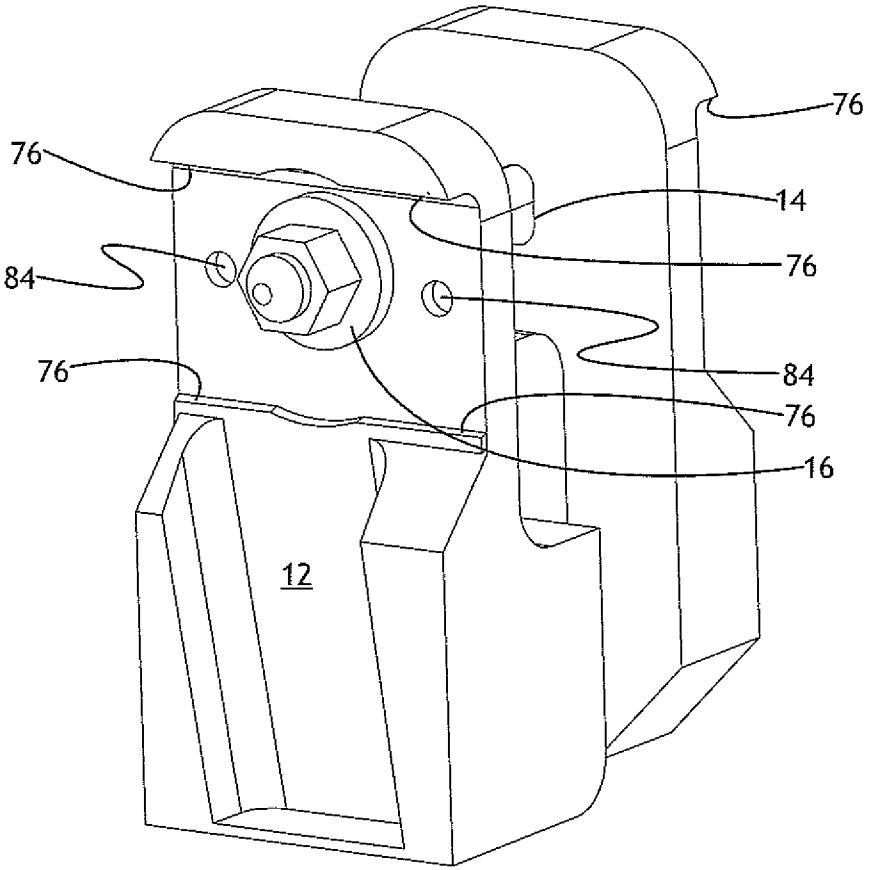
FIG. 2 is an isometric view of a portion of a component having a pair of slots in which a connector that can be adjusted by the tool illustrated in FIG. 1 is disposed.
Figure 1:
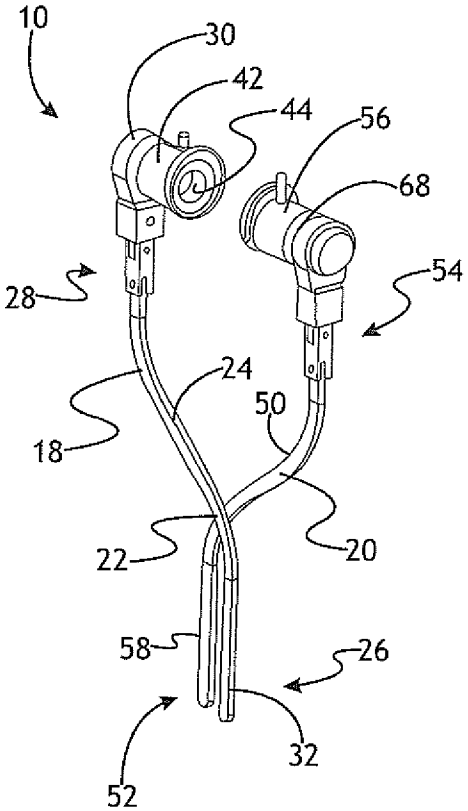
FIG. 1 is an isometric view of an illustrative embodiment of a tool for adjusting the alignment of a connector carried within a slot.

Referring in more detail to the drawings, FIG. 1 depicts an illustrative embodiment of a tool 10 for adjusting the alignment of a connector carried within one or more slots disposed in one or more components being coupled together at a joint formed in part by the connector. For purposes of context, FIG. 2 depicts a component 12 having a pair of slots 14 disposed therein in which a connector 16 is carried. It will be understood that one slot 14 is shown while the other is hidden by the connector 16 disposed therein.

In its most general form, the tool 10 comprises a first member 18 and a second member 20 configured to be coupled with the first member 18 at a pivot joint 22, and at least one of the first and second members includes an alignment feature 23 (shown in FIGS. 4 and 5) configured to react against one or more reaction features of the one or more components in which the slots are disposed to adjust the alignment of the connector within the slots.

Figure 3:
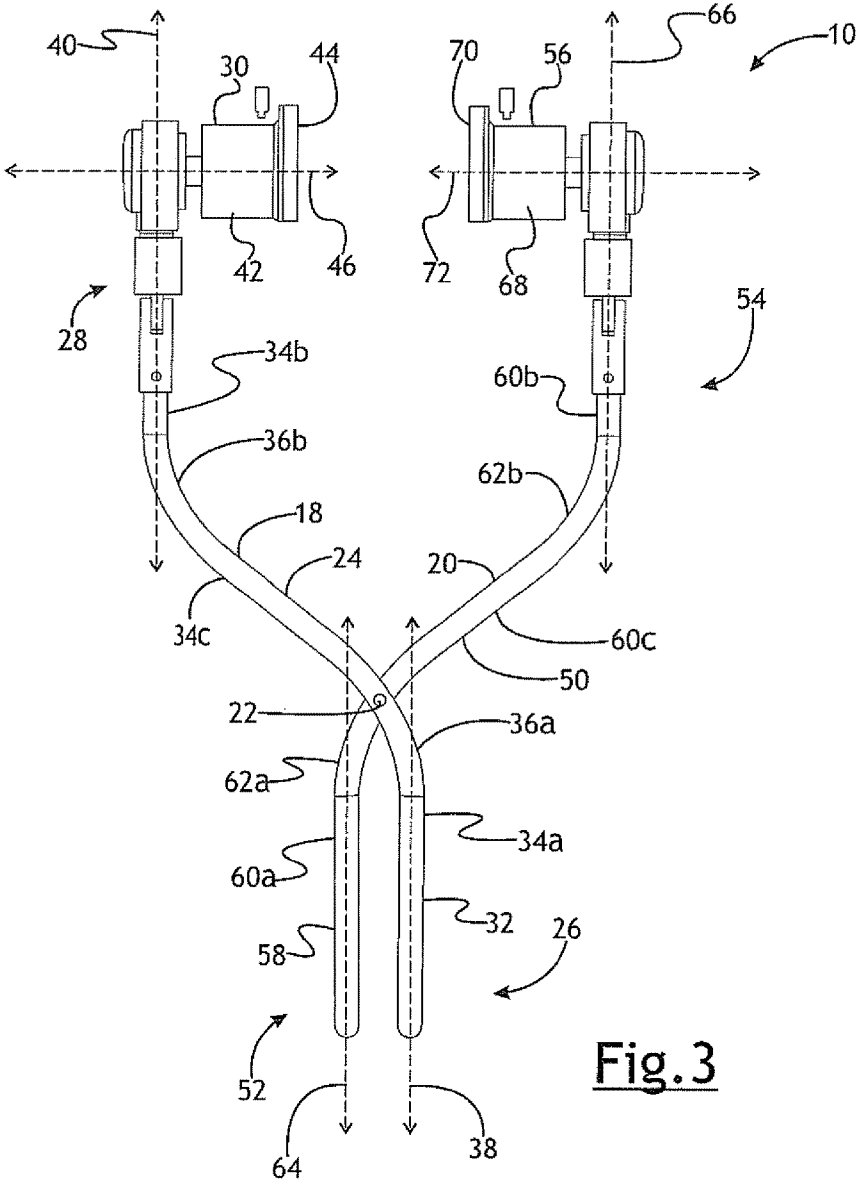
FIG. 3 is a side elevation view of the tool illustrated in FIG. 1.

As shown in FIGS. 1 and 3, the first member 18 includes an elongate shaft 24 having a proximal end 26 and a distal end 28 opposite the proximal end, and a tool head 30 carried by the shaft 24 at the distal end 28 thereof. The shaft 24 may also include a user grip 32 at or near the proximal end 26 thereof that facilitates use of the tool by a user.

As will be described in more detail below, the shaft 24 may have one or more straight portions 34 and one or more curved or contoured portions 36. More specifically, in an embodiment such as that illustrated in FIG. 3, the shaft 24 may include a first straight portion 34*a* extending from the proximal end 26 thereof towards the distal end 28 and having a longitudinal axis 38. The shaft 24 may also include a second straight portion 34*b* extending from the distal end 28 thereof towards the proximal end 26 and having a longitudinal axis 40 that, in at least some embodiments, is offset from (i.e., not coaxial with) the longitudinal axis 38 of the straight portion 34*a*. Between the straight portions 34*a*, 34*b*, the shaft 24 may further include a first curved portion 36*a* extending from the end of the first straight portion 34*a* towards the distal end 28 of the shaft 24, and a second curved portion 36*b* extending from the end of the second straight portion 34*b* towards the proximal end 26 of the shaft 24. And in at least some embodiments, the shaft 24 may further include a third straight portion 34*c* extending between the first and second curved portions 36*a*, 36*b*.

While in the embodiment described above and shown in FIG. 3 the shaft 24 includes a plurality of both straight and curved portions, it will be appreciated that the present disclosure is not intended to be limited to the shaft 24 having any particular number of straight and/or curved portions. Rather the shaft 24 may include more or fewer straight portions and/or curved portions than the embodiment described above, or may not include or the other of straight and curved portions.

In any event, the tool head 30 of the first member 18 comprises a body 42 configured to engage a first portion of the connector 16. For purposes of illustration only, the description below will primarily be with respect to an embodiment wherein the connector 16 comprises a bolt having a head, a shank, and, in at least some instances, one or more components mated with the shank, for example and without limitation, a washer, a bushing, and/or a nut. It will be appreciated, however, that that the tool 10 may be used to adjust the alignment of connectors other than a bolt, and thus, the present disclosure is not intended to be limited to any particular connector(s).

In an embodiment, the body 42 has an aperture 44 therein that both has a central axis 46 and is configured to receive the first portion of the connector/bolt (e.g., the head of a bolt or a flange thereof, or a washer, or a bushing mated with the shank of the bolt). In an embodiment, the central axis 46 is oriented at a non-zero angle relative to a longitudinal axis of a distal portion of the shaft 24. For example, in the embodiment illustrated in FIG. 3, the central axis 46 is oriented at a non-zero angle relative to the longitudinal axis 40 of the straight portion 34*b* of the shaft 24. The central axis 46 may be oriented at an angle that is substantially perpendicular to the longitudinal axis 40. For purposes of this disclosure, "substantially perpendicular" means exactly perpendicular or within a predetermined number of degrees of perpendicular. For example, in some embodiments, "substantially perpendicular" includes instances where the central axis 46 and the longitudinal axis 40 are oriented at an angle that is within 0-30° of perpendicular. It will be appreciated, however, that "substantially perpendicular" may include any suitable angle or range of angles of perpendicular, and thus, the present disclosure is not intended to be limited to any particular angle or range of angles. Alternatively, the central axis may be oriented at a non-zero angle relative to the longitudinal axis 40 that is not substantially perpendicular. Accordingly, the present disclosure is not intended to be limited to any particular non-zero angle or ranges of non-zero angles.

In at least some embodiments, the aperture 44 has a cross-sectional shape sized to receive a portion of the bolt (e.g., the head of the bolt). In some embodiments, the aperture 44 has a circular cross-sectional shape, while in other embodiments, such as, for example, that illustrated in FIG. 4, the aperture 44 has a non-circular cross-sectional shape. The aperture may have one or more internal features 48 (e.g. flat or planar sections) configured to engage the bolt (e.g., the head of the bolt) and to prevent relative movement between the bolt and the body 42 of the tool head 30. The aperture 44 may have the same number of internal features 48 as the bolt head the aperture 44 is configured to receive (e.g., for a bolt head having six sides (i.e., a hex bolt), the aperture 44 includes six internal features) or may have more or less internal features 48 than the bolt head has sides. For example, in an embodiment, the aperture 44 may have a number of internal features 48 that is double the number of sides. Accordingly, the present disclosure is not intended to be limited to any particular number of internal features. Further, in some embodiments, the aperture may comprise a through aperture extending completely through the body of the tool head, while in other embodiments the aperture does not extend all the way through the body and thus comprises a blind aperture.

In at least some embodiments, the tool head may be adjustable along the shaft to change the range of movement (i.e., swing) of the tool. For example, the tool head may be telescopically coupled with the shaft to allow the tool head to be moved along the shaft. In at least some embodiments, one or both of the tool head and the shaft may include known components or features (e.g., clips pins, apertures, etc.) to allow for the tool head to move along the shaft. In other embodiments, the tool head 30 is fixed and cannot be adjusted along the shaft 24. Further, in some embodiments the tool head may be detachable from the shaft using known detachment mechanisms (e.g., similar to a socket wrench where a socket is detachable from the wrench); while in other embodiments the tool is not detachable.

Like the first member 18, the second member 20 includes an elongate shaft 50 having a proximal end 52 and a distal end 54 opposite the proximal end 52, and a tool head 56 carried by the shaft 50 at the distal end thereof. The shaft 50 may also include a user grip 58 at the or near the proximal end thereof that facilitates use of the tool by a user.

As will be described in more detail below, in an embodiment, the shaft 50 has one or more straight portions 60 and one or more curved or contoured portions 62. More specifically, in an embodiment such as that illustrated in FIG. 3, the shaft 50 includes a first straight portion 60*a* extending from the proximal end 52 thereof towards the distal end 54 and having a longitudinal axis 64. The shaft 50 may also include a second straight portion 60*b* extending from the distal end 54 thereof towards the proximal end 52 and having a longitudinal axis 66 that, in at least some embodiments, is radially offset from (i.e., not coaxial with) the longitudinal axis 64 of the straight portion 60*a*. Between the straight portions, the shaft 50 may include a first curved portion 62*a* extending from the end of the first straight portion 60*a* towards the distal end 54 of the shaft 50, and a second curved portion 62*b* extending from the end of the second straight portion 60*b* towards the proximal end 52 of the shaft 50. And in at least some embodiments, the shaft 50 may further include a third straight portion 60*c* extending between the first and second curved portions 62*a*, 62*b*.

While in the embodiment described above and shown in FIG. 3, the shaft 50 includes a plurality of both straight and curved portions, it will be appreciated that the present disclosure is not intended to be limited to the shaft 50 having any particular number of straight and/or curved portions. Rather the shaft 50 may include more or fewer straight portions and/or curved portions than the embodiment described above, or may not include one or the other of straight and curved portions.

In any event, the tool head 56 of the second member 20 comprises a body 68 configured to engage a second portion of the connector/bolt (e.g., the shank of the bolt and/or a nut or other component mated with the shank of the bolt). In an embodiment, the body 68 has an aperture 70 therein that has a central axis 72 and is configured to receive the second portion of the connector/bolt, for example, a portion of a nut that is mated with the shank of the bolt. In at least some embodiments, the central axis 72 of the aperture 70 is oriented at a non-zero angle relative to a longitudinal axis of a distal portion of the shaft. For example, in the embodiment illustrated in FIG. 3, the central axis 72 is oriented at a non-zero angle relative to the longitudinal axis 66 of the straight portion 60*b* of the shaft 50. The central axis 72 may be oriented substantially perpendicular to the longitudinal axis 66. For purposes of this disclosure, "substantially perpendicular" means exactly perpendicular or within a predetermined number of degrees of perpendicular. For example, in some embodiments, "substantially perpendicularly" includes instances where the central axis 72 and the longitudinal axis 66 are oriented at an angle that is within 0-30° of perpendicular. It will be appreciated, however, that "substantially perpendicularly" may include any suitable angle or range of angles of perpendicular, and thus, the present disclosure is not intended to be limited to any particular angle or range of angles. Alternatively, the central axis 72 may be oriented at a non-zero angle relative to the longitudinal axis 66 that is not substantially perpendicular. Accordingly, the present disclosure is not intended to be limited to any particular non-zero angle or ranges of non-zero angles.

Figure 5:
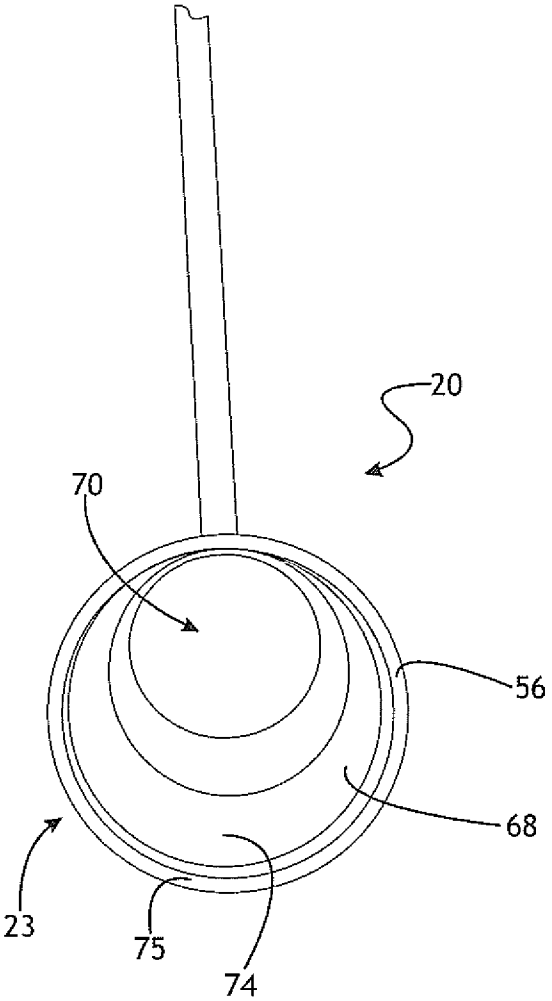
FIGS. 4 and 5 are a plan views of tool heads of the tool illustrated in FIGS. 1 and 3.

As shown in FIG. 5, in at least some embodiments, the aperture 70 has a cross-sectional shape sized to receive a portion of a nut mated with the shank of the bolt (e.g., a flange of the nut). In an embodiment, the aperture 70 is also sized and shaped to receive a tool (e.g., a socket of a socket wrench) to allow for the loosening or tightening of the nut. It will be appreciated, however, that the present disclosure is not intended to be limited to any particular cross-sectional shape or size for the aperture but instead the aperture 70 may have any suitable cross-sectional shape (e.g., circular or non-circular, like aperture 44 described above) and/or size. Additionally, in some embodiments, the aperture 70 may include internal features like those described above with respect to aperture 44 that are configured to engage the nut or a portion thereof and to prevent relative movement between the nut and the body 68 of the tool head 56. Further, in some embodiments, the aperture 70 may comprise a through aperture extending completely through the body 68 of the tool head 56, while in other embodiments the aperture 70 does not extend all the way through the body 68 and thus comprises a blind aperture.

As with the tool head 30 of the first member 18 described above, in at least some embodiments, the tool head 56 may be adjustable along the shaft 50 to change the range of movement (e.g., swing) of the tool 10. For example, the tool head may be telescopically coupled with the shaft to allow the tool head to be moved along the shaft. In at least some embodiments, one or both of the tool head and the shaft may include known components or features (e.g., clips pins, apertures, etc.) to allow for the tool head to move along the shaft. In other embodiments, the tool head 56 is fixed and cannot be adjusted along the shaft 50. Further, in some embodiments the tool head may be detachable from the shaft using known detachment mechanisms (e.g., similar to a socket wrench where a socket is detachable from the wrench); while in other embodiments the tool is not detachable.

As briefly described above, and as shown in, for example, FIGS. 1 and 3, the second member 20 is configured to be coupled with the first member 18 at the pivot joint 22. As such, each of the shaft 24 of the first member 18 and the shaft 50 of the second member 20 may have a through aperture (not shown) into which a rivet, pin, or some other suitable fastener may be inserted to form the pivot joint 22 and couple the first and second members 18, 20 together. When the shafts 24, 50 are coupled together at the pivot joint 22, one or both of the shafts may be rotatable about a pivot axis of the pivot joint 22 such that movement of the proximal ends 26, 52 of one or both of the shafts 24, 50 away from the proximal end of the other shaft causes one or both of the tool heads 30, 56 to move toward the other tool head, while movement of the proximal end 26, 52 of one or both of the shafts 24, 50 towards the proximal end of the other shaft causes one or both of the tool heads 30, 56 to move away from the other tool head.

In an embodiment such as that shown in, for example, FIG. 3, when the shafts 24, 50 are coupled together, the shafts may curve towards each other as each shaft extends from the proximal end thereof toward the pivot joint 22 (e.g., at curved portions 36*a*, 62*a*), may converge to a point at the pivot joint 22, and may curve away from each other as each of the shafts extend from the pivot joint 22 toward the distal ends thereof (e.g., at curved portions 36*b*, 62*b*). It will be appreciated, however, that other arrangements of the shafts 24, 50 may be suitable, and thus, the present disclosure is not limited to any particular arrangement(s).

While the description above has been primarily with respect to an embodiment wherein each the tool head includes an aperture (i.e., female feature) configured to receive a portion of a connector, the present disclosure is not intended to be limited to such an arrangement for engaging the tool heads and respective portions of a connector. For example, in other embodiments, one or both of the tool heads, and the body or bodies thereof, in particular, may additionally or alternatively include a male member or feature sized and shaped to be received by a complementary female feature in one or more portions of the connector. When the male feature or member of the tool head is inserted into the female feature of the connector, the body of the tool head engages the connector. Accordingly, the present disclosure is not intended to be limited to any particular arrangement for engaging the tool heads and a connector.

As briefly described above, at least one of the first and second members 18, 20 of the tool 10 includes an alignment feature 23. In the embodiment of the tool 10 illustrated in FIGS. 1 and 3-5, for each of the first and second members 18, 20 that includes the alignment feature 23, the body of the tool head of that member comprises a cam 74 that comprises the alignment feature 23, and the aperture in the body of the tool head is off-center in the cam 74 such that the cam 74 is eccentric with respect to the central axis of the aperture.

Figure 4:
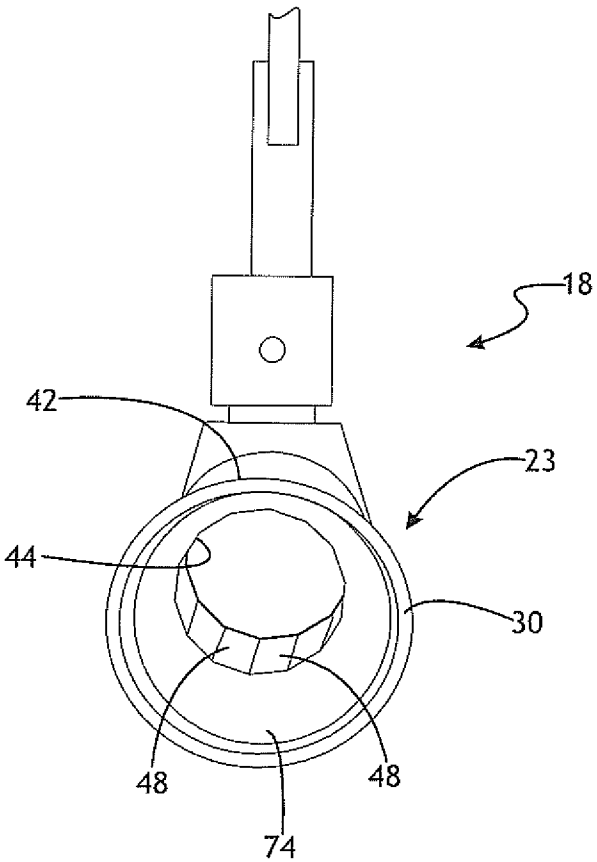

More specifically, and with respect to the embodiment illustrated in FIG. 4, if the first member 18 of the tool 10 includes the alignment feature 23, then the body 42 of the tool head 30 of the first member 18 comprises a cam 74 that, in turn, comprises the alignment feature 23. As shown in FIG. 4, the aperture 44 in the body 42 of the tool head 30 is off-center in the cam 74 such that the cam 74 is eccentric with respect to the central axis 46 of the aperture 44.

Similarly, if the second member 20 of the tool 10 additionally or alternatively includes an alignment feature 23, then the body 68 of the tool head 56 of the second member 20 comprises a cam 74 that, in turn, comprises the alignment feature 23. As shown in FIG. 5, the aperture 70 in the body 68 of the tool head 56 is off-center in the cam 74 such that the cam 74 is eccentric with respect to the central axis 72 of the aperture 70.

In an embodiment such as that illustrated in FIGS. 1 and 3-5, the cam 74 of each alignment feature 23 is configured such that when a head of a bolt 16 is received in the aperture 44 of the tool head 30 of the first member 18 and/or a nut is received in the aperture 70 of the tool head 56 of the second member 20, and the tool 10 is rotated about the axis of the bolt 16, each cam 74 reacts against a respective reaction feature 76 (best shown in FIG. 2) of the component 12 in which one or more of the slots 14 are disposed. As the tool rotates and the cam(s) 74 react against the reaction feature(s) 76, a force is applied to the bolt 16 in a direction opposite the direction in which the tool 10 is rotated. The force applied to the bolt 16 causes the bolt 16 to move in a within the slots 14 in which it is disposed, thereby adjusting its alignment within the slots 14. The offset/eccentric arrangement of the cam causes an increased displacement of the bolt with an increased rotation of the tool and bolt relative to the reaction feature(s). The cam includes an engagement surface that varies in distance from the central axis 46 of the aperture 44 (and/or the central axis 72 of the aperture 70) from a minimum distance to a maximum distance. A maximum adjustment or displacement of the bolt occurs when the portion of the cam 74 that is located farthest from the central axis 46 of the aperture 44 (and/or the central axis 72 of the aperture 70), which is shown generally at reference numeral 75 in FIGS. 3 and 4, is engaged with the reaction feature(s).

Figures 6, 7, 8:
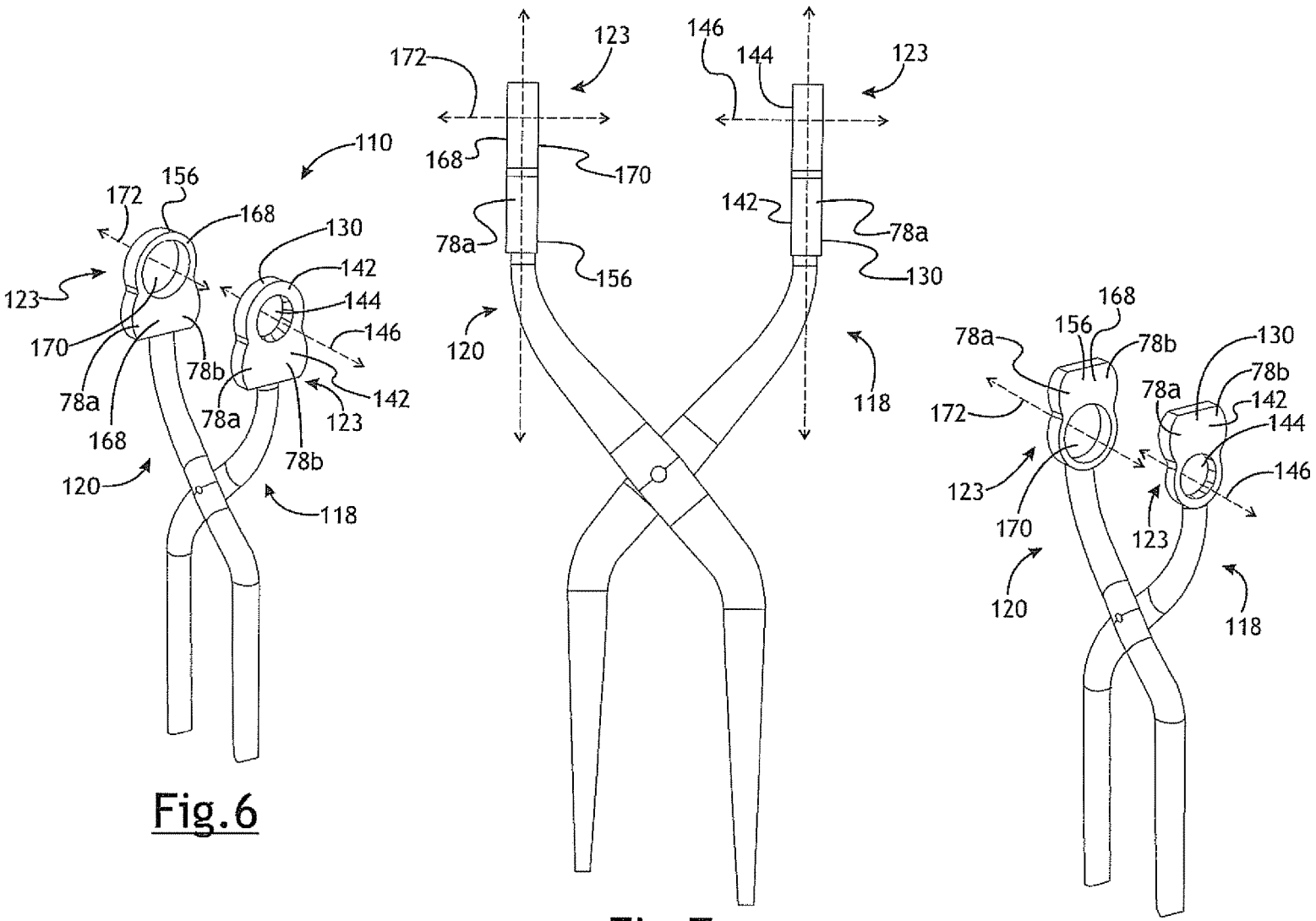
FIG. 6 is an isometric view of a tool for adjusting the alignment of a connector carried within one or more slots.
FIG. 7 is a side elevation view of the tool illustrated in FIG. 6.
FIG. 8 is an isometric view of a tool for adjusting the alignment of a connector carried within one or more slots.

FIGS. 6-8 illustrate another embodiment of a tool 110 for adjusting the alignment of a bolt carried within a pair of slots disposed in one or more components. Except as otherwise described herein, the description above relating to the tool 10 applies to this embodiment of the tool 110 with equal weight, and thus, will not be repeated but rather is incorporated here by reference. In the embodiment illustrated in FIGS. 6-8, for each of the first and second members 118, 120 that includes an alignment feature 123, the tool head of that member comprises one or more cam lobes 78, and that or those cam lobes 78 comprises the alignment feature 123. Each of the one or more cam lobes 78 is radially offset from the central axis of the aperture in the body of the tool head of which it is a part, and may be located either proximal to the aperture (i.e., between the aperture and the shaft as shown in FIG. 6) or distal to the aperture (i.e., the aperture is disposed between the cam lobes 78 and the shaft as shown FIG. 8).

More specifically, if the first member 118 of the tool 110 includes an alignment feature 123, then the body 142 of the tool head 130 of the first member 118 includes one or more cam lobes 78 (e.g., cam lobes 78*a*, 78*b*) radially offset from the central axis 146 of the aperture 144 that comprise(s) the alignment feature 123. As shown in FIG. 6, the cam lobes 78*a*, 78*b* may be proximal to the aperture 144, or, as shown in FIG. 8, distal to the aperture 144.

Similarly, if the second member 120 of the tool 110 additionally or alternatively includes an alignment feature 123, then the body 168 of the tool head 156 of the second member 120 includes one or more cam lobes 78 (e.g., cam lobes 78*a*, 78*b*) radially offset from the central axis 172 of the aperture 170 that comprise(s) the alignment feature 123. As shown in FIG. 6, the cam lobes 78*a*, 78*b* may be proximal to the aperture 170, or, as shown in FIG. 8, distal to the aperture 170.

In the embodiment illustrated in FIGS. 6-8, the cam lobes 78 of each alignment feature 123 are configured such that when a bolt 16 is received in the aperture 144 of the tool head 130 of the first member 118 and/or a nut is received in the aperture 170 of the tool head 156 of the second member 120, and the tool 110 is rotated about the axis of the bolt 16, certain of the cam lobes 78 react against respective reaction features 76 (best shown in FIG. 2) of the component 12 in which one or more of the slots 14 are disposed. As the tool 110 rotates and the cam lobe(s) 78 react against the reaction feature(s) 76, a force is applied to the bolt 16 in a direction opposite the direction in which the tool 110 is rotated. The force applied to the bolt causes the bolt 16 to move within the slots 14 in which it is disposed, thereby adjusting its alignment in the slots 14. The offset arrangement of the cam lobes causes an increased displacement of the bolt with an increased rotation of the tool and bolt relative to the reaction feature(s). A maximum adjustment or displacement of the bolt occurs when the portion of the cam lobe that is located farthest from the central axis 146 of the aperture 144 (and/or the central axis 172 of the aperture 170) is engaged with the reaction feature(s).

Figure 10:
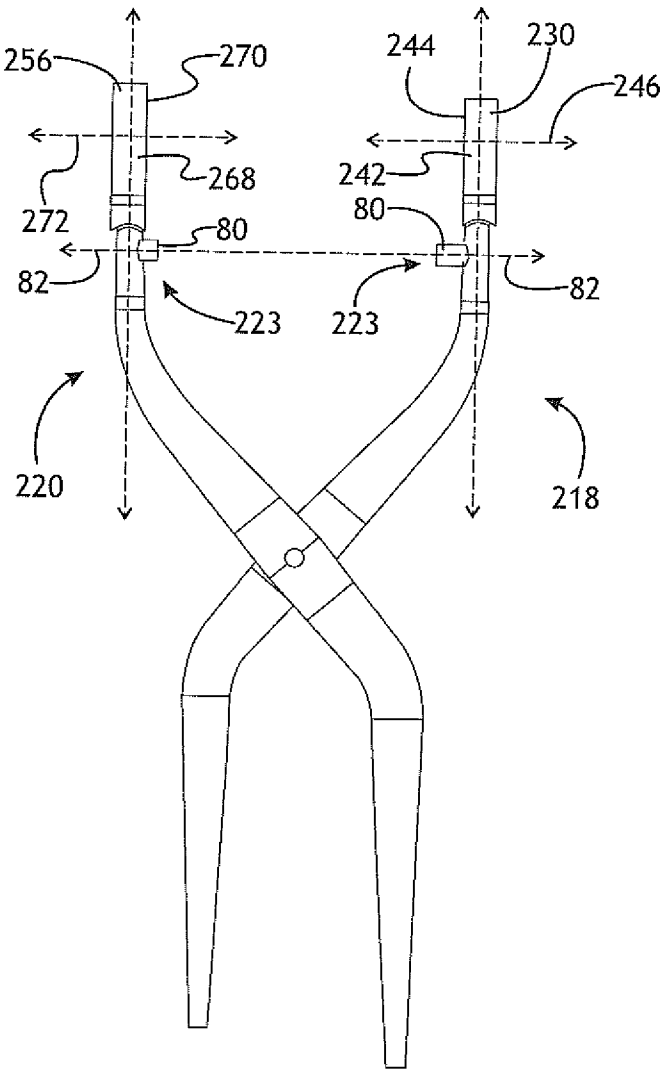
FIG. 10 is a side elevation view of the tool illustrated in FIG. 9.
Figure 9:
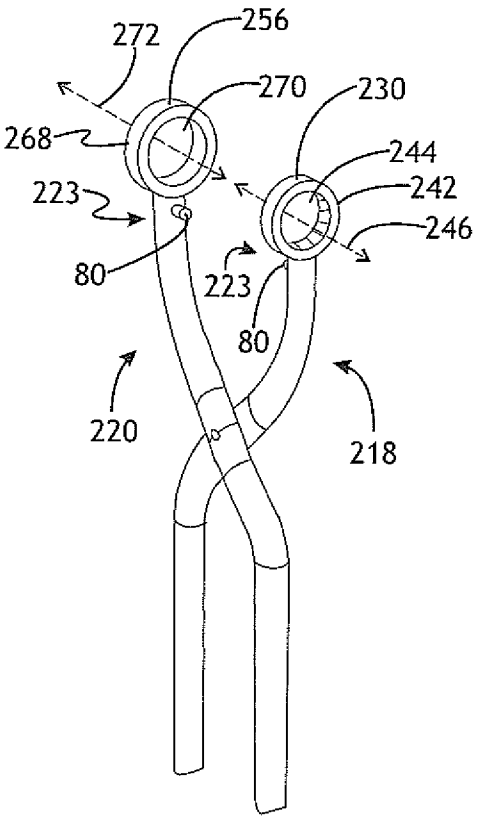
FIG. 9 is an isometric view of a tool for adjusting the alignment of a connector carried within a pair of slots.

FIGS. 9 and 10 illustrate yet another embodiment of a tool 210 for adjusting the alignment of a bolt carried within a pair of slots disposed in one or more components. Except as otherwise described herein, the description above relating to the tool 10 applies to this embodiment of the tool 210 with equal weight, and thus, will not be repeated but rather is incorporated here by reference. In the embodiment illustrated in FIGS. 9 and 10, for each of the first and second members 218, 220 that includes an alignment feature 223, that member comprises a projection 80 that extends outwardly from a distal portion of the shaft of that member and that is radially offset from the central axis of the aperture in the tool head of that member (i.e., in at least some embodiments, the projection 80 has a longitudinal axis 82 that is parallel to but radially offset from the central axis of the aperture). The projection 80 is configured to be received within a complementary void or aperture 84 in the component 16 in which one or more of the slots 14 are disposed, and to react against one or more interior surfaces (i.e., reaction feature(s) 76) of that void or aperture.

More specifically, if the first member 218 of the tool 210 includes an alignment feature 223, then the first member 218 includes a projection 80 that extends radially outward from a distal portion of the shaft 224 and that is radially offset from the central axis 246 of the aperture 244 in the body 242 or the tool head 230, and that projection 80 comprises the alignment feature 223.

Similarly, if the second member 220 of the tool 210 additionally or alternatively includes an alignment feature 223, then the second member 220 includes a projection 80 that extends radially outward from a distal portion of the shaft 250 and that is radially offset from the central axis 272 of the aperture 270 in the body 268 of the tool head 256, and that projection 80 comprises the alignment feature 223.

In the embodiment illustrated in FIGS. 9 and 10, the projection 80 of each adjustment feature 223 is configured such that when it is inserted into a complementary aperture 84 in the component 16 in which one or more of the slots 14 are disposed, the bolt 16 is received in the aperture 244 of the tool head 230 of the first member 218, and/or a nut is received in the aperture 270 of the tool head 256 of the second member 220, and the tool 210 is rotated about the axis of the bolt 16, the projection 80 reacts against the interior surface of the aperture 84 in which it is inserted. As the tool 210 rotates and the projection reacts against the interior surface of the aperture 84, a force is applied to the bolt 16 in a direction opposite the direction of rotation of the tool 210. The force applied to the bolt 16 causing the bolt 16 to move within the slots 14 in which it is disposed, thereby adjusting its alignment in the slots 14.

What is claimed is:

1. A tool for adjusting the alignment of a connector carried within a slot disposed in a component, the tool comprising:

a first member including an elongate shaft and a tool head carried by the shaft, wherein the tool head comprises a body configured to engage a first portion of the connector; and a second member configured to be coupled with the first member at a pivot joint and including an elongate shaft and a tool head carried by the shaft, wherein the tool head comprises a body configured to engage a second portion of the connector, wherein the first member includes an alignment feature having an engagement surface configured to react against a reaction surface of the component having the slot to adjust the alignment of the connector within the slot, wherein the body of the tool head of the first member includes an aperture that has a central axis and is configured to receive the first portion of the connector, and the engagement surface is radially offset from the central axis such that rotation of the first member about the central axis changes the position of the aperture relative to the engagement surface to move the connector in the slot.

2. The tool of claim 1, wherein:

the body of the second member comprises an aperture therein that has a central axis and is configured to receive the second portion of the connector.

3. The tool of claim 1, wherein the aperture in the body of the tool head of the first member has a non-circular cross-section including a plurality of internal features configured to engage the first portion of the connector and to prevent relative movement between the first portion of the connector and the body of the tool head.

4. The tool of claim 2, wherein the aperture in the body of the tool head of the second member has a non-circular cross-section including a plurality of internal features configured to engage the second portion of the connector and to prevent relative movement between the second portion of the connector and the body of the tool head.

5. The tool of claim 1, wherein the second member includes an alignment feature having an engagement surface configured to react against the component having the slot to adjust the alignment of the connector within the slot when the second member is rotated about the central axis.

6. The tool of claim 1, wherein the body of the tool head of first member comprises a cam and the cam includes the engagement surface; and the aperture in the body of the tool head is off-center in the cam such that the engagement surface is eccentric with respect to the central axis of the aperture.

7. The tool of claim 1, wherein the tool head of first member comprises multiple cam lobes and the multiple cam lobes comprise the alignment feature, and each of the multiple cam lobes are radially offset from the central axis of the aperture in the body of the tool head.

8. The tool of claim 1, wherein first member comprises a projection extending outwardly from the shaft of that member and the projection comprises the engagement surface, and the projection is configured to be received within a void in the one or more components in which the slots are disposed and to react against one or more interior surfaces of that void.

9. The tool of claim 1, wherein the position of at least one of the tool head of the first member and the tool head of the second member is adjustable along the shaft of the first member or second member, respectively.

10. The tool of claim 1, wherein each of the first and second members comprise a user grip portion at the proximal end thereof.

11. The tool of claim 1, wherein the tool is configured to rotate about the axis of the connector to adjust the alignment of the connector in the slots.

12. A tool for adjusting the alignment of a connector carried within a one or more slots disposed in one or more components, the tool comprising:

a first member including:

an elongate shaft having a proximal end and a distal end;

a tool head carried by the shaft at the distal end thereof and comprising a body having an aperture with a central axis; and an alignment feature having a surface radially offset from the central axis, the surface configured to engage one or more reaction surfaces of the one or more components; and a second member configured to be coupled with the first member at a pivot joint and including:

an elongate shaft having a proximal end and a distal end;

a tool head carried by the shaft at the distal end thereof and comprising a body having an aperture with a central axis; and an alignment feature having a surface radially offset from the central axis, the surface configured to engage one or more reaction surfaces of the one or more components that are different from the one or more reaction surfaces that the alignment feature of the first member is configured to engage, wherein rotation of the tool about the central axis of the first member radially moves the aperture of the first member, and radially moves the aperture of the second member.

13. The tool of claim 12, wherein the aperture in the body of the tool head of the first member has a non-circular cross-section including a plurality of internal features configured to engage the first portion of the connector and to prevent relative movement between the first portion of the connector and the body of the tool head.

14. The tool of claim 12, wherein the aperture in the body of the tool head of the second member has a non-circular cross-section including a plurality of internal features configured to engage the second portion of the connector and to prevent relative movement between the second portion of the connector and the body of the tool head.

15. The tool of claim 12, wherein:

the body of the tool head of the first member comprises a cam and the cam comprises the alignment feature of the first member, and the aperture in the body of the tool head of the first member is off-center in the cam such that the cam is eccentric with respect to the central axis of the aperture, and an engagement surface of the cam defines the surface of the alignment feature, and the engagement surface varies in distance from the central axis of the aperture of the body from a minimum distance to a maximum distance, the engagement surface is adapted to engage a reaction surface as the tool is rotated; and the body of the tool head of the second member comprises a cam and the cam comprises the alignment feature of the second member, and the aperture in the body of the tool head of the second member is off-center in the cam such that the cam is eccentric with respect to the central axis of the aperture, and an engagement surface of the cam defines the surface of the alignment feature, and the engagement surface varies in distance from the central axis of the aperture of the body from a minimum distance to a maximum distance, the engagement surface is adapted to engage a reaction surface as the tool is rotated.

16. The tool of claim 12, wherein:

the tool head of the first member comprises multiple cam lobes that comprise the alignment feature of the first member, wherein each of the multiple cam lobes are radially offset from the central axis of the aperture in the body of the tool head of the first member, and an engagement surface of the cam lobes varies in distance from the central axis of the aperture of the body from a minimum distance to a maximum distance, the engagement surface is adapted to engage a reaction surface as the tool is rotated; and the tool head of the second member comprises multiple cam lobes that comprise the alignment feature of the second member, wherein each of the multiple cam lobes are radially offset from the central axis of the aperture in the body of the tool head of the second member, and an engagement surface of the cam lobes varies in distance from the central axis of the aperture of the body from a minimum distance to a maximum distance, the engagement surface is adapted to engage a reaction surface as the tool is rotated.

17. The tool of claim 12, wherein:

the first member comprises a projection extending radially outwardly from a distal portion of the shaft thereof and the projection comprises the alignment feature of the first member, wherein the projection is configured to be received within an aperture in the one or more components in which the slots are disposed and to react against one or more interior surfaces of that aperture to adjust the position of the connector within the slots; and the second member comprises a projection extending radially outwardly from a distal portion of the shaft thereof and the projection comprises the alignment feature of the second member, wherein the projection is configured to be received within another aperture in the one or more components in which the slots are disposed and to react against one or more interior surfaces of that aperture to adjust the position of the connector within the slots.

18. The tool of claim 12, wherein the position of at least one of the tool head of the first member and the tool head of the second member is adjustable along the shaft of the first member or second member, respectively.

19. The tool of claim 12, wherein the tool is configured to rotate about the axis of the connector to adjust the alignment of the connector in the slots.

* * * * *